United States Patent [19]

Knapp et al.

[11] Patent Number: 4,671,566

[45] Date of Patent: Jun. 9, 1987

[54] COLLAPSIBLE SUPPORT APPARATUS

[76] Inventors: Ronald H. Knapp, 98-1033 Kupukupu Pl., Aiea, Hi. 96701; Richard Tillotson, 2006 Oswald St., Honolulu, Hi. 96816

[21] Appl. No.: 325,875

[22] Filed: Nov. 30, 1981

[51] Int. Cl.[4] ..... A47C 4/00

[52] U.S. Cl. ..... 297/16; 248/188.6; 248/188.7; 297/441

[58] Field of Search ..... 297/16, 441; 248/177, 248/188.6, 649, 166, 170, 188.7

[56] References Cited

U.S. PATENT DOCUMENTS

| | | | |
|---|---|---|---|
| 589,464 | 9/1897 | Church | 248/166 X |
| 2,473,090 | 6/1949 | Becker | 297/441 X |
| 2,722,972 | 11/1955 | Altruda | 297/441 X |
| 2,854,061 | 9/1958 | Romito | 248/188.7 |
| 2,858,140 | 10/1958 | Stamp | 297/16 X |
| 3,396,928 | 8/1968 | Lay | 248/188.6 |
| 3,483,999 | 12/1969 | Barrett | 248/188.6 X |
| 3,501,118 | 3/1970 | Meinunger | 248/177 X |
| 4,047,752 | 9/1977 | Rohr | 297/16 X |
| 4,324,433 | 4/1982 | Saiger | 248/188.7 X |

FOREIGN PATENT DOCUMENTS

| | | | |
|---|---|---|---|
| 615777 | 9/1958 | Italy | 297/16 |
| 2025213 | 1/1980 | United Kingdom | 297/16 |

*Primary Examiner*—James T. McCall
*Attorney, Agent, or Firm*—James C. Wray

[57] ABSTRACT

A collapsible chair has a sheet of flexible mesh material supported by four arms extending in a tetrahedral pattern from a self-locking, gravity-operated base joint. The outward ends of the front arms are angled upwardly. U-shaped stabilizing legs pivot outwardly from the front arms to a forwardly extended position. The support arms are received in pockets in the flexible sheet to permit detachment thereof. The arms are pivotally connected to the base joint to permit them to be folded parallel to each other. The hollow rectangular lower ends of the arms telescopically receive similiarly shaped guide arms on the base joint to permit axial movement between an upward position in which the arms are freely pivotable and a downward position in which the arms are automatically locked in the tetrahedral position.

26 Claims, 8 Drawing Figures

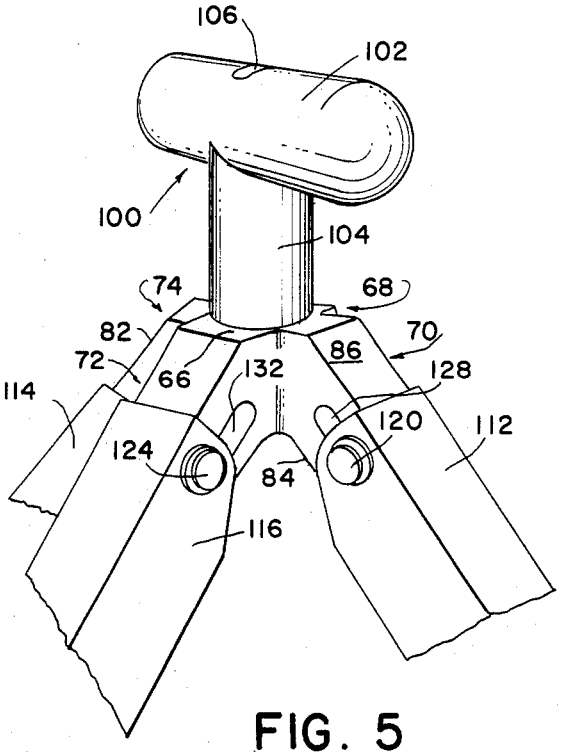
FIG. 5
FIG. 6
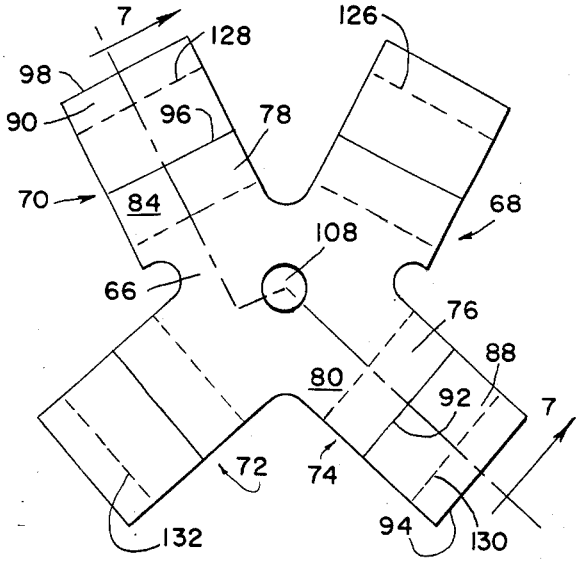
FIG. 7
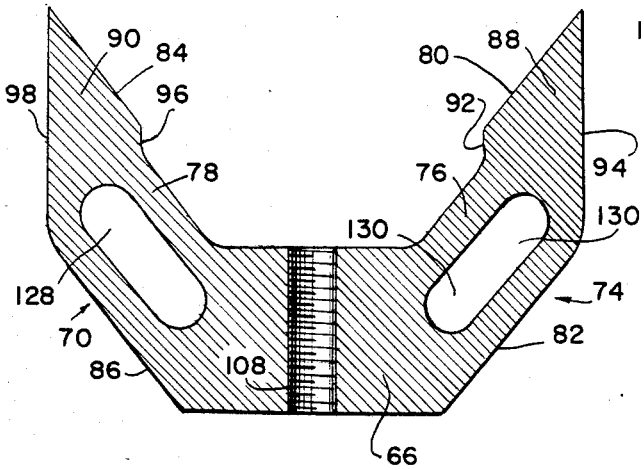
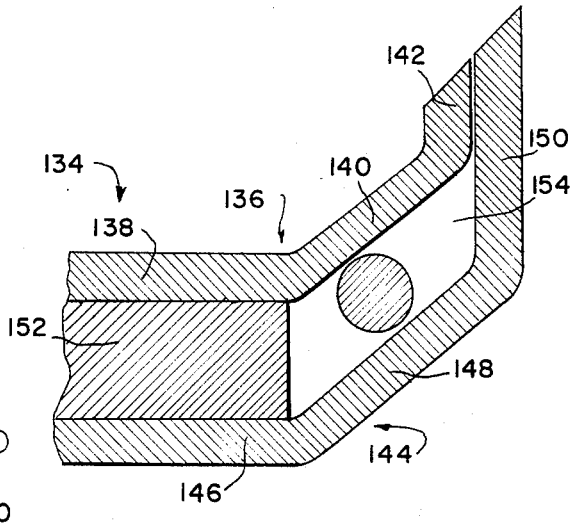
FIG. 8

COLLAPSIBLE SUPPORT APPARATUS

BACKGROUND OF THE INVENTION

This invention relates generally to support devices and more particularly has reference to a collapsible chair.

Pertinent U.S. and foreign patents are found in Class 182, subclass 33 and Class 297, subclasses 16, 31, 42, 45, 46, 51, 54, 55, 441, 449 and 457 of the Official Classifications of Patents in the U.S. Patent and Trademark Office.

Examples of pertinent patents are U.S. Pat. Nos. 2,473,090; 2,712,349; 4,047,752; 4,251,106; and 4,258,951.

U.S. Pat. No. 2,473,090 shows a collapsible hammock-style chair that is suspended from four supports extending upward from a common base. The vertical stem base is supported off the ground by four other support members. The two sets of support members are connected to opposite ends of the stem base to provide the chair with strength and compactness.

U.S. Pat. No. 2,712,349 discloses another hammock-style chair that can be disassembled to facilitate its portability. The tripod structure of the chair allows for stability while maintaining a lightweight construction.

U.S. Pat. No. 4,047,752 discloses a collapsible hammock-style chair that has a tripod structure for its base.

U.S. Pat. No. 4,251,106 discloses a hammock-style lounging chair that is constructed from two interengaging frames. The first frame is a Y-shaped array, and the second frame is an X-shaped array. The chair can be disassembled and stored in a small carrying bag.

U.S. Pat. No. 4,258,951 discloses a collapsible hammock-style chair that can be stored in a small carrying bag. The base of the chair is a double tripod construction. The front articulated assembly can also be pivotally mounted on U-shaped brackets.

A need has long existed for a comfortable outdoor chair suitable for campers, beachgoers, picnickers or anyone else wishing to sit comfortably out of doors. Such a chair must be capable of being collapsed or folded compactly so that it can be easily carried from one location to another. It is also essential that such a chair have a structural design that derives the maximum strength from the minimum amount of materials so that weight, size and cost are reduced. Known chairs, including those described in the above mentioned patents, have proved unsatisfactory in meeting all of these criteria.

SUMMARY OF THE INVENTION

The present invention overcomes many of the shortcomings which exist in the prior art devices.

Briefly, the invention is a collapsible, hammock-style chair or seat that is suspended on a tension-compression structure. This particular structure allows the lines of force to run down the length of the supporting members, thus providing strength while minimizing the size and weight of the members.

Four supports extend upward and outward from a common, self-locking, gravity-operated base joint. Two front legs extend from the two front supports to stabilize the structure.

The base joint has four upwardly and outwardly extending guide arms of rectangular cross-section. The lower end of each support is formed into a square tube which is telescopically fitted over one of the guide arms. The tubes have transverse bars which are received within slots formed in the guide arms to act as pivot pins. The slot-pin connection also limits the telescopic movement of the supports.

Inverting and lifting the base allows the supports to telescopically slide along the guide arms until they hang parallel to each other in an extremely compact arrangement. Righting the base allows the supports to telescope downwardly onto the base and to be automatically deployed and locked in a tetrahedral arrangement.

Objects of the inventions are, therefore, to provide an improved support apparatus and to provide an improved collapsible chair.

Another object of the invention is to provide a lightweight chair which is structured to support heavy loads.

Another object of the invention is to provide a chair having a tension-compression structure wherein the lines of force run down the length of the supporting members, rather than across or perpendicular to them.

Still another object of the invention is to provide a comfortable chair having a vertical hammock shape.

Still another object of the invention is to provide a hammock-style chair which can be readily compacted and easily transported.

Still another object of the invention is to provide a collapsible chair in which the support arms are automatically folded, automatically deployed, and automatically locked in the deployed position.

A further object of the invention is to provide a collapsible chair or other support device having a self-locking, gravity-operated joint.

A further object of the invention is to provide a hammock-style chair in which the support arms are arranged so that they do not brush up against a person seated in the chair.

A further object of the invention is to provide a supporting structure which is sturdy and self-leveling.

Yet another object of the invention is to provide a hammock-style chair having a flexible mesh or net body support which retains its seat shape and which conforms to the body of a seated person without any bunching or rolling of excess material.

Yet another object of the invention is to provide a collapsible support assembly comprising a joint member having a base portion with a plurality of outwardly divergent guide arms extending upwardly therefrom, support arms having lower ends pivotally connected to the guide arms for pivotal movement between a collapsed position in which the support arms extend generally parallel to each other and a deployed position in which the support arms diverge outwardly from the joint member, said lower ends being telescopically arranged on the guide arms for axial translation with respect thereto when the support arms are in the deployed position, said translation permitting movement between an upward position in which the support arms are freely pivotable with respect to the guide arms and a downward position in which the support arms are automatically locked against pivotal movement with respect to the guide arms.

Yet another object of the invention is to provide a chair assembly comprising a joint member having a base for resting on a support surface, plural support arms connected to the joint member and diverging outwardly and upwardly therefrom, a body support member connected to the support arms remote from the joint member, said support arms suspending the body support member above the support surface to provide a seat supporting portion and a back supporting portion, leg means connected to at least one of said support arms between the joint member and the body support member, said leg means extending outwardly and downwardly from the support arms and being provided at outward ends with feet for resting on a support surface, at least one of said support arms having an upwardly angled outward end portion connected to the seat supporting portion of the body support member.

These and other and further objects and features of the invention are apparent in the disclosure which includes the above and below specification and claims and drawings.

BRIEF DESCRIPTION OF THE DRAWINGS

FIG. 5 is an elevational detail of the base joint and the lower ends of the support arms shown in FIGS. 1–4.

FIG. 6 is a top plan view of the base joint shown in FIG. 5 disconnected from the support arms.

FIG. 7 is a sectional view taken along the line 7—7 in FIG. 6.

FIG. 8 is a fragmentary sectional view of a modified base joint.

DETAILED DESCRIPTION OF THE DRAWINGS

Figure 2:
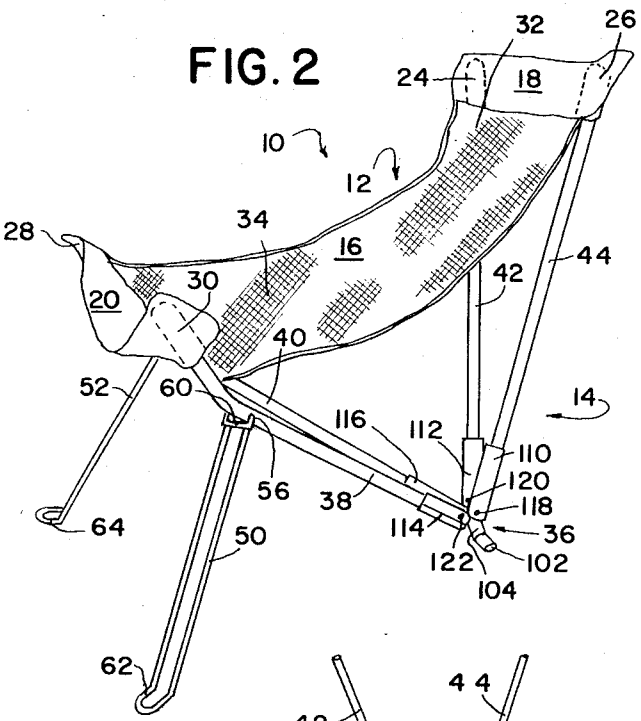
FIG. 2 is a perspective view of the chair shown in FIG. 1.
Figure 1:
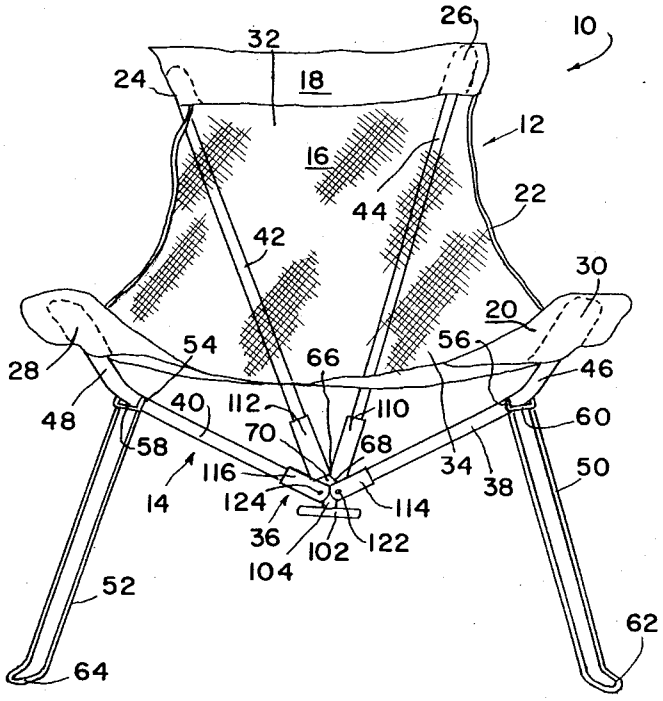
FIG. 1 is a front elevational view of a chair embodying features of the present invention.

Referring to FIGS. 1 and 2, a collapsible chair assembly embodying features of the present invention is generally indicated by the numeral 10.

The chair 10 has a body supporting member 12 which is suspended and supported in a hammock-style fashion by a support assembly 14.

The body supporting member 12 is formed of a sheet 16 of flexible material. The sheet can have any desired shape, such as a square shape or a rectangular shape. However, the preferred shape has a relatively short, straight upper edge, a relatively long, straight lower edge and inwardly curved side edges, as shown in FIG. 1. The preferred shape economizes on material and also causes the member 12 to conform to the body of a seated person without any bunching or rolling of excess material.

The member 12 can be formed of any flexible material. Net is the preferred material because it is light, cool, strong and very inexpensive. However, materials such as canvas or synthetic mesh can also be used.

The preferred net material is very compliant and thus does not require darts to create a seated shape. Preferably, cords 22 are sewn along the side edges of the net sheet 16 and bands of strong cloth 18 and 20 are sewn along the top and bottom edges respectively of the net sheet 16. The bands 18 and 20 and cord 22 preserve the seated shape of the body supporting member 12 and thus prevent a person from sliding out of the member 12 when seated.

Pockets 24 and 26 and pockets 28 and 30 are sewn into the corners of the bands of material 18 and 20 respectfully. These pockets are configured to receive the ends of the support arms 38 - 44 of the support assembly 14. With this arrangement, the supporting member 12 can be easily connected or disconnected to the support assembly 14.

Although the precise location of the pockets 24–30 can be varied as desired, it is preferred that the pockets be arranged so that the support points for the body supporting member 12 are at the ends of the support arms 38–44. That arrangement ensures that the lines of force remain essentially parallel to the support arms 38–44.

As can be seen in FIGS. 1 and 2, the body supporting member 12 is supported and suspended by the support assembly 14 so as to provide a back supporting portion 32 and a seat supporting portion 34 for a person seated therein. This vertical hammock shape has been found to be the most comfortable and readily compactible support for a sitting person. It is considerably more comfortable than conventional outdoor chairs and backrests.

Figure 3:
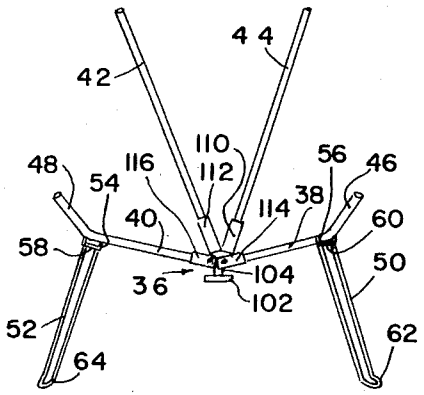
FIG. 3 is a front elevational view of the chair shown in FIG. 1 with the hammock removed.

The support assembly 14 is best shown in FIGS. 1–3.

The support assembly 14 is designed to derive maximum strength from a minimum amount of materials. When deployed as shown in FIGS. 1–3, the support assembly 14 is a tension-compression structure. The lines of force from the body supporting member 12 run down the length of the support arms 38–44, rather than across or perpendicular to them. This makes the most of the strength of these support arms so that their size and weight can be minimized.

The support assembly 14 has a base joint 36 which is designed to rest on a support surface such as the ground. Support arms 38–44 diverge upwardly and outwardly from the base joint 36 to form the inverted tetrahedral structure best shown in FIG. 2. Although this tetrahedral structure is preferred because it best utilizes the desired tension-compression principles, it is understood that the support assembly can have other structures. The number of support arms, the angular relationships between the support arms, and the angular relationships between the support arms and the base joint can all be varied without departing from the present invention.

As shown in the figures, the angle between the ground and the front support arms 38 and 40 is considerably smaller than the angle between the ground and the rear support arms 42 and 44, so that the tetrahedral structure is tilted forwardly. This arrangement assures the desired tension-compression structure.

The tetrahedral structure is stabilized by a pair of legs 50 and 52 extending outwardly and forwardly from outer portions of the front support arms 38 and 40 respectively. The length of the legs 50 and 52 and the angles between the legs 50 and 52 and the arms 38 and 40 can be varied as desired, but it is preferred that those parameters be selected to provide the tetrahedral support arm array with the orientation described above.

Preferably, the legs 50 and 52 are made from metal rods which are forged into an elongated U-shape. The outward ends of the legs 50 and 52 are bent at an angle to create feet 62 and 64. The inward ends of the legs 50 and 52 are bent inwardly and inserted into holes 54 and 56 formed in the front support arms 38 and 40 to provide a pivotal connection between the legs 52 and 50 and the front support arms 38 and 40. Transverse metal links or braces 58 and 60 are welded to the legs 50 and 52 at a location spaced slightly from the openings 54 and 56. These braces 58 and 60 abut the support arms 38 and 40 to prevent further outward pivotal movement of the legs 52 and 50 when the legs are in the desired position.

The positions of the braces 58 and 60 and the holes 54 and 56 determine the angles of the legs 50 and 52. This is determined by the angles chosen for the support arms 38–44, which angles are in turn determined by the above described ideal hammock orientation and shape. If it is desired to change that orientation or shape, all the angles and positions will change as well.

The base joint 36 is provided with a downwardly extending inverse T-shaped foot 100. The foot 100 has a cylindrical cross portion 102 connected to the end of a cylindrical neck portion 104 which extends from the lower surface of the base joint. The cross portion 102 abuts the ground or other supporting surface to provide support for the inverted tetrahedral array of support arms 38 - 44. The cross portion 102, in combination with the feet 62 and 64 of the legs 50 and 52, form a tripod structure which provides sturdy and self-leveling support for the support arm array even on uneven surfaces.

Preferably, the cross portion 102 is arranged so that its axis is perpendicular to the direction in which a seated person is facing. In addition, it is preferred that the cross portion 102 be rounded so that it can rock back and forth and assume the most stable position on uneven ground.

Preferably, the neck portion 104 is sufficiently long to keep the base joint 36 elevated above sand or dirt.

The forward support arms 38 and 40 have upwardly angled outward end portions 46 and 48 which extend from a point outward of the openings 54 and 56. In the preferred embodiment, the end portions 46 and 48 have a length of about 6", but it is understood that that dimension can be varied without departing from the present invention. The upward angulation of the end portions 46 and 48 raises the seat supporting portion 34 of the body supporting member 12 a distance above the front support arms 38 and 40 so that a person seated in the chair 10 does not brush up against support members near his legs.

Details of the base joint 36 are shown in FIGS. 5–7.

The base joint 36 has a base portion 66 with a plurality of outwardly divergent guide arms 68–74 extending upwardly and outwardly therefrom. The number of guide arms is identical to the number of support arms. The preferred embodiment has four guide arms, two guide arms 68 and 70 connected to the rear support arms 44 and 42 respectively, and two guide arms 72 and 74 connected to the front support arms 40 and 38 respectively.

Preferably, the guide arms 68–74 have rectangular cross-sectional shapes and the lower ends of the support arms 38–44 are provided with square tubes 110–116 which telescopically receive the guide arms 68–74, as best shown in FIG. 5. The square tubes 110–116 are fitted on the guide arms 68–74 so that they slide smoothly with very close tolerances. The square shapes of the guide arms 68–74 and tubes 110–116 keep the support arms 38–44 from rotating.

Each of the tubes 110–116 is provided with bars or pivot pins 118–124 which are received within axial slots 126–132 formed in the guide arms 68–74. Preferably, the axial slots 126–132 extend through the guide arms 68–74 and the pivot pins 118–124 in each tube 110–116 are unitary pins which extend through the slots 126–132 and have ends which are rigidly connected to the sides of the square tubes 110–116 adjacent the slots 126–132. The pins 118–124 can be welded or fixed to the tubes 110–116 in any other conventional manner.

This arrangement allows the tubes 110–116 to be pivoted with respect to the guide arms 68–74. Moreover, the pivot pins 118–124 are free to ride up and down the axial slots 126–132 when the tubes 110–116 are translated axially with respect to the guide arms 68–74.

The shape of the guide arms 68–74 controls the freedom of movement of the support arms 38–44 and also determines the relative positions which those arms can assume. That shape is best described with reference to FIG. 7.

Front guide arm 74 has a first portion 76 of generally rectangular cross-section extending upwardly and outwardly from the base portion 66 at an oblique angle and a second portion 88 of generally rectangular cross-section extending upwardly from the outward end of the first portion 76, the second portion 88 having an axis generally perpendicular to the base portion 66. The portions 76 and 88 provide a first set of surfaces 80 and 82 which abut the inner walls of the square tube 114 when the tube 114 has been translated axially inwardly on the guide arm 74. Imaginary linear extensions of the surfaces 80 and 82 will define the position of the support arm 38. This position is the deployed position shown in FIGS. 1–3.

The second portion 88 of the guide arm 74 provides a second set of surfaces 92 and 94 which abut the inner walls of the square tube 114 when it has been translated axially outwardly. Imaginary linear extensions of the surfaces 92 and 94 will define the position of the support arm 38. That position is the folded position shown in FIG. 4.

As shown in FIG. 7, guide arm 70 has similarly arranged first and second portions 78 and 90 and first and second sets of surfaces 84, 86, 96 and 98. Guide arms 68 and 72 are also provided with similarly arranged first and second portions and first and second sets of surfaces. Although all the guide arms 68–74 have a similar arrangement of first and second portions and first and second sets of surfaces, it is understood that the specific angular parameters can differ among the guide arms 68–74. For example, the guide arms 68 and 70 connected to the rear support arms 42 and 44 can have different angular parameters than the guide arms 72 and 74 connected to the front support arms 38 and 40 so as to achieve the desired forward tilt of the tetrahedral array discussed above.

In the preferred embodiment, the base portion 66 and guide arms 68–74 are formed integrally from a single piece of cast metal. The base portion 66 is provided with a threaded axial bore 108 which receives a bolt 106 extending axially through the foot 100, thereby attaching the foot 100 to the base portion 66.

Use of the chair 10 can now be readily understood.

By grasping the cross portion 102 of the foot 100 and using it as a handle, the user can invert and lift the base joint 36 for easy carrying of the chair.

When the base joint 36 is inverted and lifted, the tubes 110–116 slide down the guide arms 68–74 until the pivot pins 118–124 abut the ends of the axial slots 126–132. The pins 118–124 and slots 126–132 are arranged so that the ends of the tubes 110–116 clear the corners formed by the intersections of the first and second guide arm portions, thus causing the support arms 38–44 to pivot inwardly and downwardly toward each other until the inner walls of the tubes 110–116 are brought into abutment with the second sets of surfaces. The support arms 38–44 are then in the fully folded or collapsed position shown in FIG. 4. The folded support arms 38–44 are generally parallel to each other.

The legs 50 and 52 are folded inwardly toward the support arms 38 and 40. The legs 50 and 52 are shaped so that the feet 62 and 64 clip around the support arms 38 and 40. The legs 50 and 52 are thus conveniently stowed and out of the way in the folded position as shown in FIG. 4.

Figure 4:
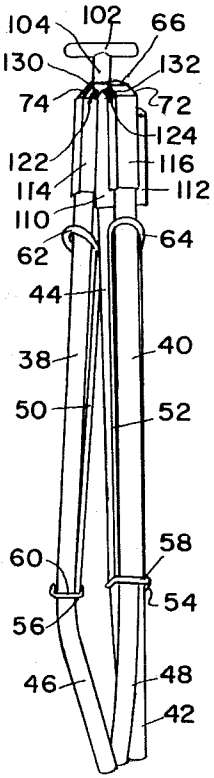
FIG. 4 is an elevational view of the support structure shown in FIG. 3 when fully collapsed.

The folded support assembly 14 shown in FIG. 4 can be readily transported by using the cross portion 102 of the foot 100 as a handle. The body supporting member 12, which was removed from the support assembly 14 prior to the above described folding procedure, can be wrapped around the folded support assembly 14 or it can be separately folded and carried.

If desired, a suitable carrying case can be provided for transporting the folded support assembly 14 and body supporting member 12. It has been found that the support assembly 14 can be designed so that it folds into a size about the same as that of the average umbrella.

To set up the chair 10, the base joint 36 is righted and the cross portion 102 of the foot 100 is rested on the ground. When the support arms 38–44 are released, their own weight causes them to pivot divergently outwardly. Simultaneously, the weight causes the square tubes 110–116 to slide down the guide arms 68–74, turning the corners formed by the intersections of the first and second guide arm portions, and continuing to slide down the guide arms 68–74 until the pivot pins 118–124 abut the ends of the axial slots 126–132 in the guide arms 68–74. The square tubes 110–116 are then braced against the first sets of surfaces which determine the precise angles for the support arms 38–44 in the deployed position. As noted above, these angles are preferably selected so that the support arms 38–44 form the inverted tetrahedral array shown in FIGS. 1–3.

The chair is completed by deploying the legs 50 and 52 and feeding the ends of the support arms 38–44 into the corresponding pockets 24–30 of the body supportinq member 12.

As previously noted, the specific angular parameters of the guide arms 68–74 are determined by the desired size and orientation of the body supporting member 12 in three-dimensional space. It is understood that those angles can be varied as desired without departing from the present invention. However, it has been found that an especially comfortable chair is provided when the angle between the front support arms 38 and 40 is about 98.4°, the angle between the rear support arms 42 and 44 is about 56°, and the angle between the axis of the base portion 66 and the inner surfaces 80 and 84 of the second portions of the guide arms 68–74 is about 39.9°.

It is further preferred that the support arms 38–44 be formed of round tubes. It is particularly desirable that the front support arms 38 and 40 be round at the points where the legs 50 and 52 attach so that the legs 50 and 52 can be easily pivoted out at the correct angle.

It is preferred that support arms 38–44 and square tubes 110–116 be formed of extruded aluminum and that the base joint 36 be formed of cast aluminum. However, it is understood that other materials can be used. Steel would be a particularly useful alternative material.

A number of modifications to the above described structure are readily apparent.

A modified base joint 134 is shown in FIG. 8. Externally, the joint 134 has a size and shape which are identical to the joint 36.

The joint 134 is formed of a top plate 136 having a first horizontal surface 138 , a second surface 140 extending upwardly and outwardly from the first surface 138 at an oblique angle, and a third surface 142 extending upwardly from the outward end of the second surface 140, the third surface being generally perpendicular to the first surface 138. A bottom plate 144 has similarly shaped surfaces 146–150. A spacer 152 is sandwiched between the horizontal portions of the plates 136 and 144. Spacer 152, inner plate 134 and outer plate 144 may be bolted or welded together. The vertical portion of the top plate 136 contacts the upper end of the vertical portion of the bottom plate 144. The space between the oblique portions of the plates 136 and 144 forms a slot 154 for slidably receiving the pivot pins connected to the square tubes 110–116.

Although FIG. 8 shows a single guide arm of the base joint 134, it will be readily appreciated that plural guide arms are formed by providing top and bottom plates 136 and 144 having plural sets of corresponding second and third surfaces extending divergently outwardly from the horizontal portions of the plates 136 and 144.

It will be readily appreciated that the base joints 36 and 134 have a variety of applications besides chairs. The principle is the same no matter how many support arms are used or what angles are chosen. For example, the joints 36 and 134 can be used in support assemblies for platforms or they could be used as a means of constructing easels or tripods.

A further modification of the base joint has the axial slots provided in the square tubes and the pivot pins projecting outwardly from the sides of the guide arms.

In another alternative embodiment, the legs 50 and 52 are formed of half-tubes instead of forged rods. The half-tubes are shaped to fit around the forward support arms 38 and 40 when in the folded position. Small plastic plates are used as feet to keep the legs from sinking into dirt or sand when deployed.

In still another alternative embodiment, U-shaped plastic pieces are attached to the under sides of the feet 62–64 to keep the feet 62 and 64 from sinking into dirt or sand.

In yet another embodiment, a small, vinyl bag is placed around the base joint, in a manner similar to the bag around the gearshift stickshift in a car to protect the joint from sand or dirt.

While the invention has been described with reference to specific embodiments, the exact nature and scope of the invention is defined in the following claims.

We claim:

1. Collapsible chair support comprising a joint member having a base portion with a plurality of outwardly divergent guide arms extending therefrom, support arms having inner ends pivotally connected to the guide arms for pivotal movement between a collapsed position in which the support arms extend generally parallel to each other and a deployed position in which the support arms diverge outwardly from the joint member, said inner ends being telescopically arranged with the guide arms for axial translation with respect thereto when the support arms are in the deployed position, said translation permitting movement between an outward position in which the support arms are freely pivotable with respect to the guide arms and in inward position in which the support arms are automatically locked against a pivotal movement with respect to the guide arms, the guide arms having a generally rectangular cross-sectional shape and the inner ends of the support arms having a corresponding rectangular cross-sectional shape, the guide arms being provided with axially extending slots and the inner ends of the support arms being provided with radially inwardly extending pivot pins slidably received within said slots.

2. The apparatus of claim 1 further comprising leg means connected to at least one of said support arms at a location remote from the joint member for pivotal movement between a folded position in which the leg means is generally parallel with the support arm and an extended position in which the leg means extends outwardly from the support arm, an outward end of said leg means being provided with a base, and an inward end of the leg having a brace which prevents further outward pivotal movement of the leg.

3. The apparatus of claim 1 wherein the inner ends of the support arms are hollow, the guide arms being telescopically received within said inner ends.

4. The apparatus of claim 1 wherein each of the guide arms has a first portion of generally rectangular cross-section extending outwardly from the base portion at an oblique angle and a second portion of generally rectangular cross-section extending from the outward end of the first portion, said second portion having an axis generally perpendicular to the base portion.

5. The apparatus of claim 1 wherein the guide arms and the base portion of the joint member are formed from a unitary metal casting.

6. The apparatus of claim 1 wherein the base portion is provided with a T-shaped foot.

7. Chair assembly comprising:

a joint member having a base for resting on a support surface, plural support arms connected to the joint member and diverging outwardly and upwardly therefrom, a body support member connected to the support arms remote from the joint member, said support arms suspending the body support member above the support surface to provide a seat supporting portion and a back supporting portion, leg means connected to at least one of said support arms between the joint member and the body support member, said leg means extending outwardly and downwardly from the support arm and being provided at an outward end with a foot for resting on a support surface, at least one of said support arms having an unwardly angled outward end portion connected to the seat supporting portion of the body support member, wherein the body support member is formed of mesh material having cord connected to said peripheral edges and having bands of flexible cloth material connected to the upper peripheral edge of the back supporting portion and the front peripheral edge of the seat supporting portion, said bands being provided with pockets for receiving outward ends of the support arms.

8. The apparatus of claim 5 wherein four support arms are connected to the joint member and diverge outwardly and upwardly therefrom to define an inverted tetrahedral shape, the back supporting portion of the body support member has corners along an upper edge connected to outward ends of two of said support arms, the seat supporting portion of the body support member has corners along a front edge connected to the outward ends of the remaining two of said support arms, said leg means are connected to said remaining two support arms, said leg means having a length and angular relationship with said remaining two support arms to support said two remaining support arms at an angle to the support surface which is smaller than the angle between the support surface and the two support arms connected to the back supporting portion, said arrangement directing force from the body supporting member downwardly along the axes of the support arms.

9. The apparatus of claim 2 wherein the leg means comprise generally elongated U-shaped members having inwardly extending pivot pins at the upper ends, said pivot pins being received within openings formed in the support arms to provide said pivotal connections between the leg means and the support arms, and further having transverse brace elements at the upper ends, said brace elements being spaced from the pivot pins to abut the support arms when the leg means are in said extended position and to thereby prevent further outward pivotal movement of the leg means.

10. The apparatus of claim 9 wherein the U-shaped members have widths at least slightly greater than the diameters of the support arms connected thereto and are provided with outwardly angled lower ends for receiving the support arms when the leg means are in the folded position.

11. The apparatus of claim 6 wherein the cross portion of the T-shaped foot is rounded.

12. The apparatus of claim 1 wherein the support arms further comprise outer ends and further comprising a hammock having means for connecting the hammock to outer ends of the support arms thereby forming a collapsible chair.

13. Chair apparatus comprising:

a base, four legs connected to base and extending outward therefrom, the legs having spaced outer termini and a body support connected to outer termini of the legs, wherein the four legs are connected via locking connections to the base whereby the legs may be locked in divergent angles with respect to the base and each other, wherein the legs comprise two legs with relatively closely spaced outer termini forming back legs and two legs forming front legs with outer termini relatively widely spaced from each other and from termini of the back legs, when the legs are locked in divergent angles, and wherein the termini of the front legs are turned toward an upward direction.

14. The chair apparatus of claim 13 further comprising auxiliary legs pivotally connected to the front legs at points near the upward turning of the front leg outer termini.

15. The chair apparatus of claim 13 wherein the auxiliary legs have stop means connected to the auxiliary legs near pivotal connections of the front legs and auxiliary legs for abutting the upward turning termini and limiting pivoting of the auxiliary legs with respect to the front legs.

16. The chair apparatus of claim 13 wherein the base comprises four divergent guide arms and wherein the legs have inward end portions complementarily configured with respect to the guide arms for sliding therewith and slide limiting means for limiting relative sliding of the legs and the guide arms.

17. The chair apparatus of claim 16 wherein outer ends of the guide arms comprise means for permitting relative pivoting of the legs and guide arms when the legs and guide arms are slid to relative outward limits and wherein inner ends of the guide arms comprise means for preventing relative pivoting of the guide arms and legs when the guide arms and legs are slid relatively inward.

18. The apparatus of claim 1 wherein the joint member is formed of an inner plate defining an inner surface of the base portion and guide arms, an outer plate defining an outer surface of the base portion and guide arms, and a spacer positioned between the inner plate and the outer plate in the base portion, said slots being provided by spaces between the inner and outer plates in the guide arms.

19. The chair apparatus of claim 13 wherein the locking connections are releaseable connections whereby the legs may be released and moved inward toward each other for storing or carrying.

20. The chair apparatus of claim 13 wherein the base has a handle remote from the legs for carrying the apparatus with the base and legs inverted.

21. The chair apoaratus of claim 13 wherein the body support comprises a sling with two relatively closely spaced back pockets to receive back leg termini and two front pockets relatively widely spaced from each other and from the back pockets.

22. The chair apparatus of claim 21 wherein the slings comprises inward curved edges between adjacent front and rear pockets.

23. The apparatus of claim 7 wherein the body support member is detachably connected to the support arms.

24. The apparatus of claim 7 wherein the body support member is formed of flexible material.

25. The apparatus of claim 24 wherein the flexible material comprises a mesh material.

26. The apparatus of claim 23 wherein the body support member is provided with pockets for receiving outward ends of the support arms.

* * * * *

UNITED STATES PATENT OFFICE

CERTIFICATE OF CORRECTION

Patent No. 4,671,566 Dated June 9, 1987

Inventor(s) Ronald H. Knapp et al.

It is certified that error appears in the above-identified patent and that said Letters Patent are hereby corrected as shown below:

Column 9, line 54, change "unwardly" to --upwardly--.

Column 12, line 6, change "apoaratus" to --apparatus--.

Signed and Sealed this

Twenty-fourth Day of November, 1987

*Attest:*

DONALD J. QUIGG

*Attesting Officer*

*Commissioner of Patents and Trademarks*